US011946190B2

(12) United States Patent
Damtew

(10) Patent No.: US 11,946,190 B2
(45) Date of Patent: Apr. 2, 2024

(54) WASHING MACHINE APPLIANCE WITH HYDRAULICALLY ACTUATED DIVERTER VALVE

(71) Applicant: Haier US Appliance Solutions, Inc., Wilmington, DE (US)

(72) Inventor: Fikreadam Abebe Damtew, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 808 days.

(21) Appl. No.: 17/038,745

(22) Filed: Sep. 30, 2020

(65) Prior Publication Data

US 2022/0098784 A1 Mar. 31, 2022

(51) Int. Cl.

| | |
|---|---|
| ***D06F 39/08*** | (2006.01) |
| ***D06F 105/06*** | (2020.01) |
| ***D06F 105/08*** | (2020.01) |

(52) U.S. Cl.

CPC ..... *D06F 39/085* (2013.01); *D06F 39/088* (2013.01); *D06F 2105/06* (2020.02); *D06F 2105/08* (2020.02)

(58) Field of Classification Search

CPC .... D06F 39/083; D06F 39/085; D06F 39/088; D06F 2105/08; D06F 2105/06; Y10T 137/86075; F16K 31/1223; F16K 3/0281

USPC ..... 251/149.1, 63.5; 137/861, 118.02

See application file for complete search history.

(56) References Cited

U.S. PATENT DOCUMENTS

| | | | | | |
|---|---|---|---|---|---|
| 337,438 | A * | 3/1886 | Royce | F16K 3/0281 | 137/242 |
| 3,266,274 | A * | 8/1966 | Schwing | D06F 39/08 | 68/23.5 |
| 3,312,234 | A * | 4/1967 | Morey | D06F 35/005 | 68/19 |
| 3,367,153 | A * | 2/1968 | Brubaker | D06F 33/34 | 68/23.5 |
| 3,425,437 | A * | 2/1969 | Knerr | D06F 39/083 | 137/119.05 |
| 3,695,291 | A * | 10/1972 | Sims | D06F 39/08 | 68/902 |
| 4,245,310 | A * | 1/1981 | Kiefer | D06F 33/47 | 68/12.23 |
| 4,561,471 | A * | 12/1985 | Diaz | F16K 11/0655 | 137/625.48 |
| 5,285,665 | A * | 2/1994 | Hetrick, Jr. | D06F 39/006 | 422/123 |
| 5,307,650 | A * | 5/1994 | Mertz | D06F 34/08 | 68/18 F |

(Continued)

FOREIGN PATENT DOCUMENTS

EP 0607628 A1 7/1994

*Primary Examiner* — Daphne M Barry

(74) *Attorney, Agent, or Firm* — Dority & Manning, P.A.

(57) ABSTRACT

A fluid circulation system of a washing machine appliance includes a wash tub configured for containing fluid during operation of the washing machine appliance and a drain pump positioned below the wash tub. The fluid circulation system also includes a hydraulically actuated diverter valve coupled to the drain pump. The diverter valve is in fluid communication with the drain pump and is downstream of the drain pump. The diverter valve is configured to selectively direct a flow of fluid from the drain pump to one of the wash tub or an outlet of the washing machine appliance.

18 Claims, 11 Drawing Sheets

(56) References Cited

U.S. PATENT DOCUMENTS

| | | | | |
|---|---|---|---|---|
| 5,493,745 | A * | 2/1996 | Hauch | D06F 39/083 68/18 F |
| 9,702,079 | B2 * | 7/2017 | Bondi | D06F 39/086 |
| 2009/0229312 | A1 * | 9/2009 | Chung | D06F 39/083 417/510 |
| 2016/0047079 | A1 | 2/2016 | Maiero | |
| 2019/0301077 | A1 | 10/2019 | Eom | |

* cited by examiner

WASHING MACHINE APPLIANCE WITH HYDRAULICALLY ACTUATED DIVERTER VALVE

FIELD OF THE INVENTION

The present subject matter relates generally to washing machine appliances, and more particularly to a hydraulically-actuated diverter valve for washing machine appliances.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

The wash liquid which leaves the tub typically flows to one or more pumps by gravity. For example, a drain pump may be located within a cabinet of the washing machine appliance and may pump the wash liquid out of the washing machine appliance via a drain or outlet. Some washing machine appliances also include a recirculation pump which pumps the wash liquid back to tub. However, the inclusion of multiple pumps results in increased cost and complexity.

Accordingly, a washing machine appliance with features for selectively directing a flow of wash fluid from a single pump to multiple destinations is desirable.

BRIEF DESCRIPTION OF THE INVENTION

Aspects and advantages of the invention will be set forth in part in the following description, or may be obvious from the description, or may be learned through practice of the invention.

In one aspect of the present disclosure, a washing machine appliance is provided. The washing machine appliance defines a vertical direction, a lateral direction, and a transverse direction. The vertical direction, the lateral direction and the transverse direction are mutually perpendicular. The washing machine appliance includes a cabinet extending between a top and a bottom along the vertical direction. A wash tub is mounted within the cabinet and configured for containing fluid during operation of the washing machine appliance. A wash basket is rotatably mounted within the wash tub. The wash basket defines a wash chamber configured for receiving laundry articles. A drain pump is positioned below the wash tub along the vertical direction within the cabinet. The washing machine appliance also includes a hydraulically actuated diverter valve coupled to the drain pump. The diverter valve is in fluid communication with the drain pump and is downstream of the drain pump. The diverter valve is configured to selectively direct a flow of fluid from the drain pump to one of the wash tub or an outlet of the washing machine appliance.

In another aspect of the present disclosure, a fluid circulation system of a washing appliance is provided. The fluid circulation system includes a wash tub configured for containing fluid during operation of the washing machine appliance and a drain pump positioned below the wash tub. The fluid circulation system also includes a hydraulically actuated diverter valve coupled to the drain pump. The diverter valve is in fluid communication with the drain pump and is downstream of the drain pump. The diverter valve is configured to selectively direct a flow of fluid from the drain pump to one of the wash tub or an outlet of the washing machine appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
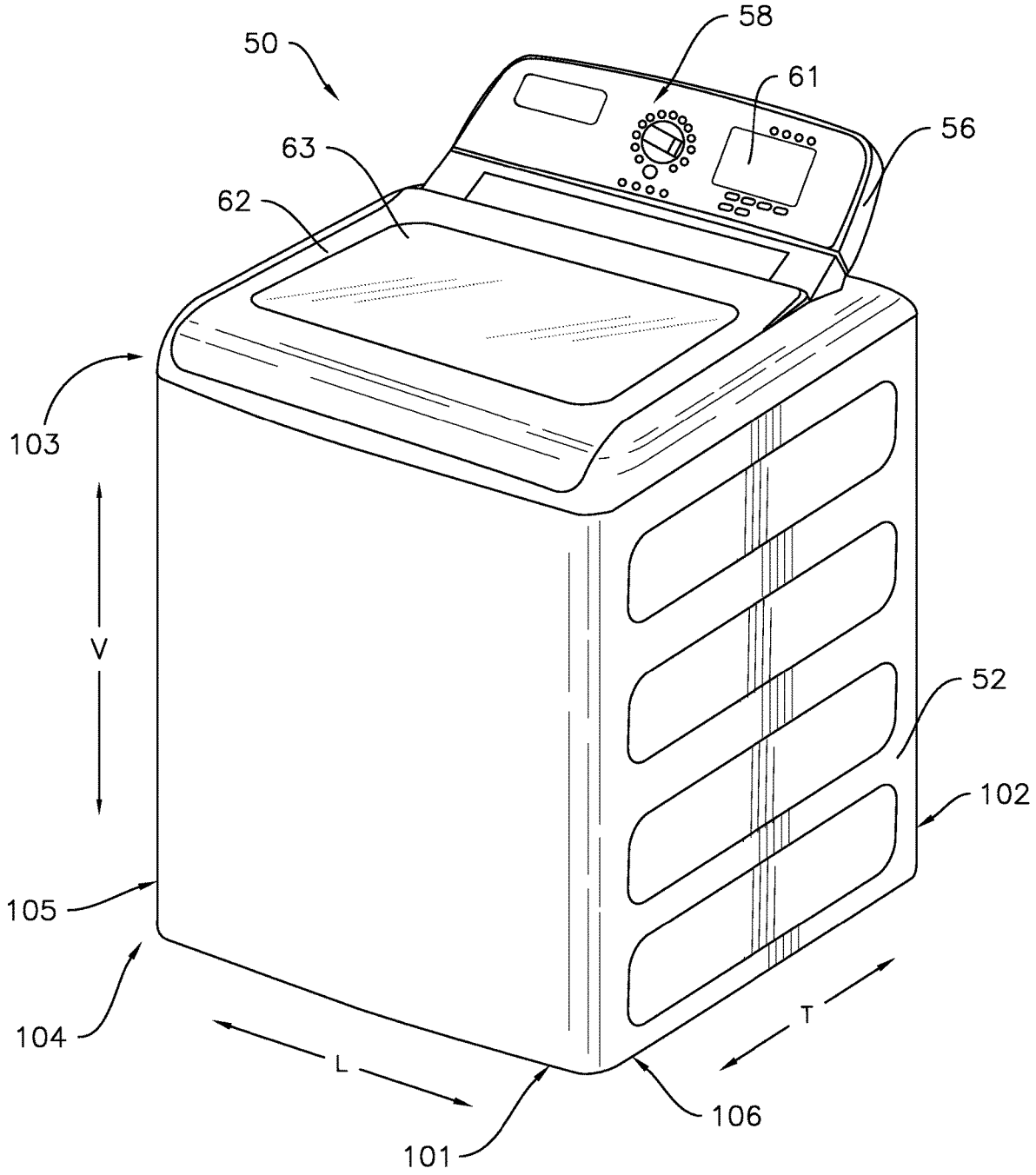
FIG. 1 provides a perspective view of a washing machine appliance according to example embodiments of the present subject matter.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, terms of approximation such as "generally," "about," or "approximately" include values within ten percent greater or less than the stated value. When used in the context of an angle or direction, such terms include within thirty degrees greater or less than the stated angle or direction, e.g., "generally vertical" includes forming an angle of up to thirty degrees in any direction, e.g., clockwise or counterclockwise, with the vertical direction V.

Figure 2:
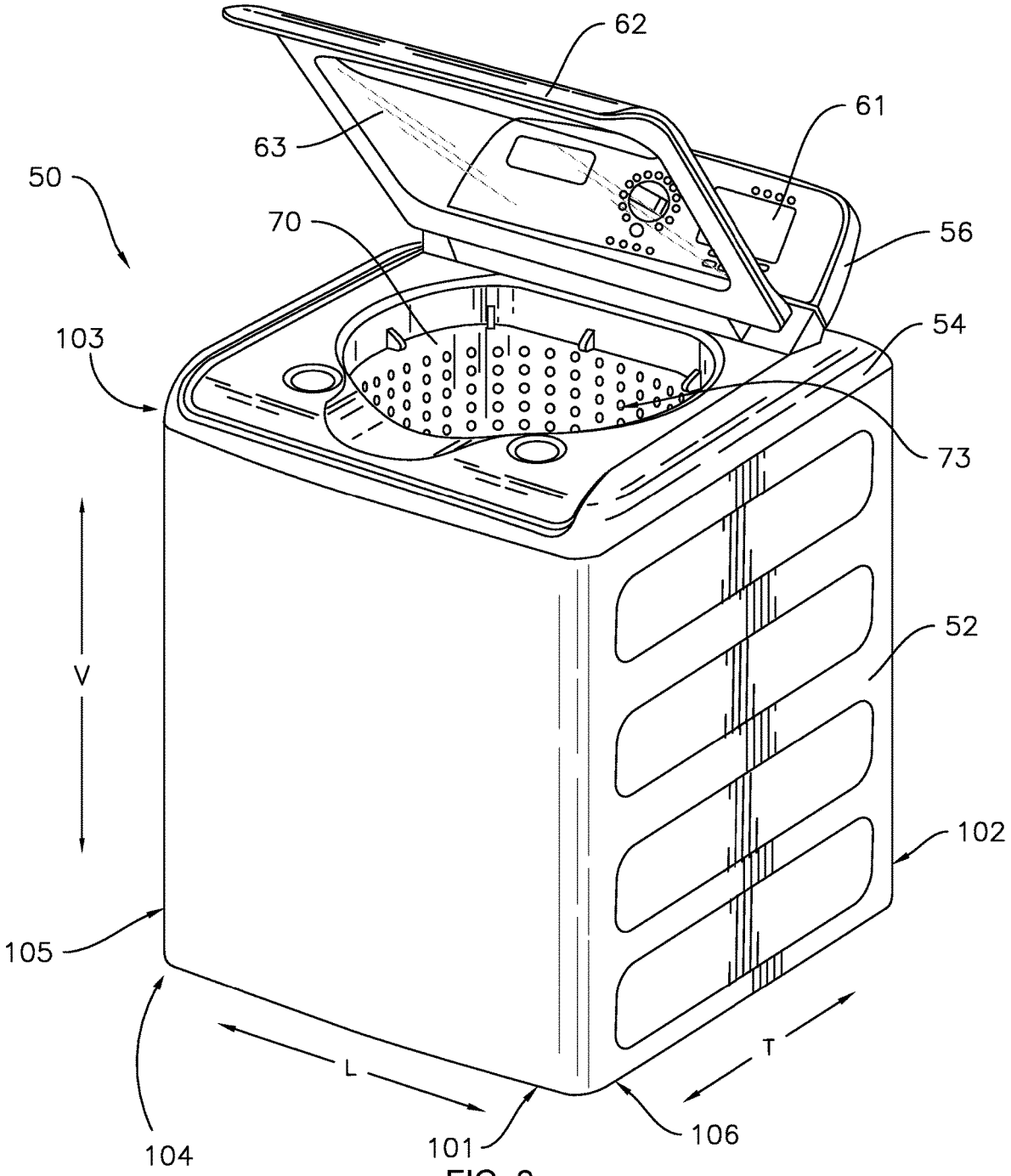
FIG. 2 provides a perspective view of the exemplary washing machine appliance of FIG. 1 with the door or lid of the washing machine appliance shown in an open position.

FIGS. 1 and 2 illustrate perspectives view of a washing machine appliance 50 according to at least one example embodiment of the present disclosure. In FIG. 1, a lid or door 62 is shown in a closed position. In FIG. 2, the door 62 is shown in an open position. Washing machine appliance 50 defines a lateral direction L, a transverse direction T, and a vertical direction V. The lateral direction L, transverse direction T, and vertical direction V are mutually perpendicular and define an orthogonal coordinate system. As shown, washing machine appliance 50 has a cabinet 52 which extends between a front side 101 and a rear side 102 along the transverse direction T, between a top 103 and a bottom 104 along the vertical direction V, and between a left side 105 and a right side 106 along the lateral direction L. The terms "left side" and "right side" are used with respect to the perspective of a user standing in front of the washing machine appliance 50, such as to access the wash basket 70 thereof, e.g., for placing articles therein for washing or removing articles therefrom after washing.

As may be seen in FIGS. 1 and 2, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface for operator selection of machine cycles and features. In some embodiments, a display 61 indicates selected features, a countdown timer, and/or other items of interest to users. A door 62 is mounted to cover 54 and is rotatable between an open position (shown in FIG. 2) facilitating access to a wash basket 70 located within cabinet 52 and a closed position (shown in FIG. 1) forming an enclosure over the wash basket 70. A window 63 in door 62 permits viewing of wash chamber 73 when door 62 is in the closed position, e.g., during operation of washing machine appliance 50.

Figure 3:
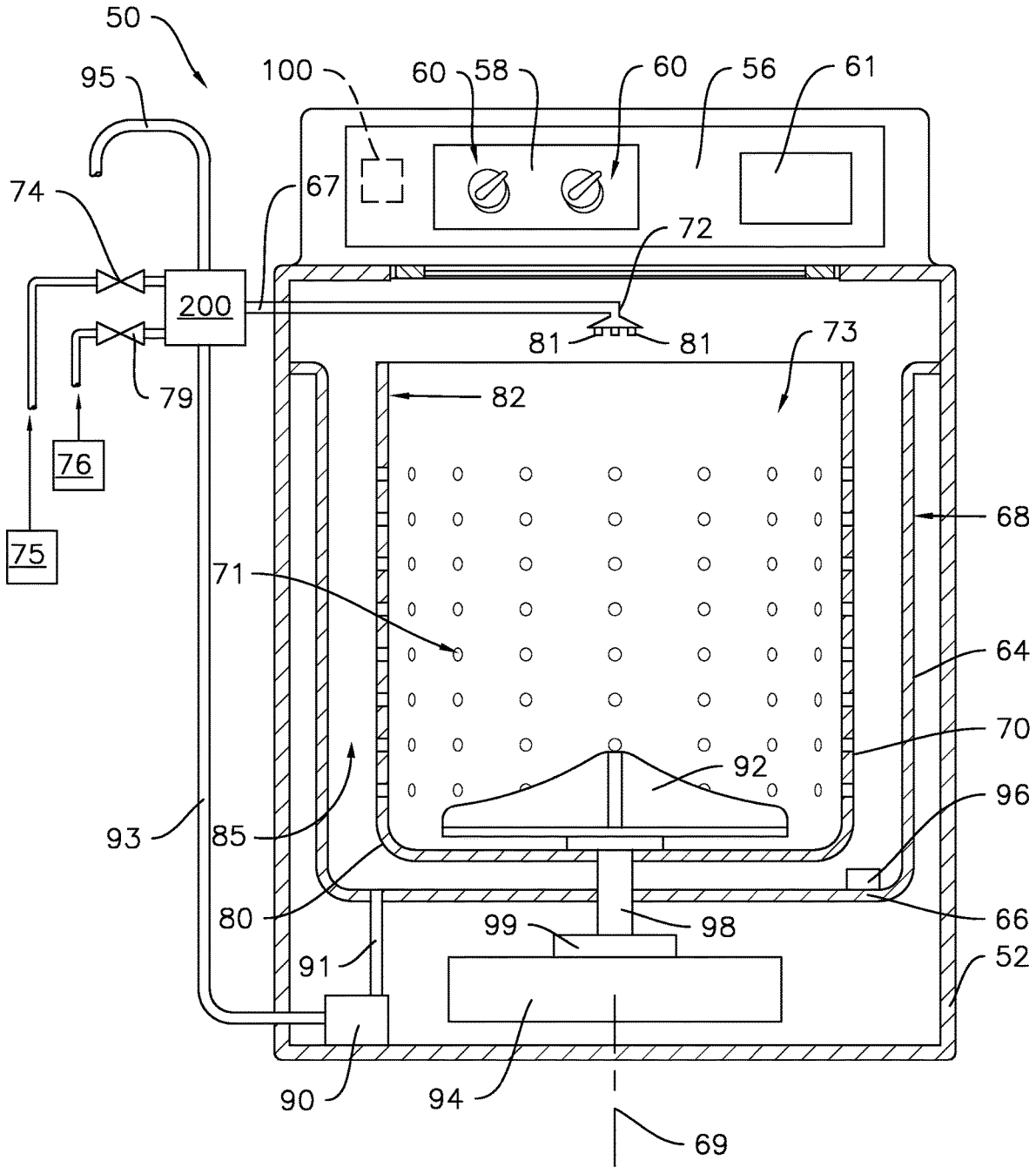
FIG. 3 provides a front cross-sectional view of the washing machine appliance of FIG. 1 according to one or more example embodiments of the present disclosure.

FIG. 3 provides a front, cross-sectional view of washing machine appliance 50. The cross-section view of FIG. 3 provides an illustration of certain internal components of the washing machine appliance 50, such as at least a portion of a fluid circulation system of the washing machine appliance 50. As may be seen in FIG. 3, tub 64 includes a bottom wall 66 and a sidewall 68. A wash drum or wash basket 70 is rotatably mounted within tub 64, defining an annulus 85 between the tub 64 and basket 70. In particular, basket 70 is rotatable about a central axis 69, which may, when properly balanced and positioned in the embodiment illustrated, be a vertical axis. Thus, washing machine appliance 50 is generally referred to as a vertical axis washing machine appliance. Basket 70 defines a wash chamber 73 for receipt of a load of articles for washing and extends, e.g., vertically, between a bottom portion 80 and a top portion 82. Basket 70 includes a plurality of openings or perforations 71 therein to facilitate fluid communication between an interior of basket 70 and tub 64.

In some embodiments, nozzle 72 is configured for flowing or directing a liquid into tub 64. In particular, nozzle 72 may be positioned at or adjacent top portion 82 of basket 70. Nozzle 72 may be in fluid communication with one or more water sources 75, 76 in order to direct liquid (e.g., water) into tub 64 and/or onto articles within chamber 73 of basket 70. For instance, a water inlet line 67 may connect to water sources 75, 76 to selectively receive water therefrom. Nozzle 72 may further include apertures 81 through which water may be sprayed into the tub 64. Apertures 81 may, for example, be tubes extending from the nozzles 72, as illustrated. Alternatively, apertures 81 may simply be holes defined in the nozzles 72 or any other suitable openings through which water may be sprayed. Nozzle 72 may additionally include other openings, holes, etc. (not shown) through which water may be flowed (i.e., sprayed or poured) into the tub 64.

One or more supply valves 74 and 79 generally regulate the flow of liquid (e.g., water) through nozzle 72. For example, each supply valve 74, 79 can selectively adjust to a closed position in order to terminate or obstruct the flow of liquid through nozzle 72. When assembled and installed for use, the supply valves 74 and 79 may each be in fluid communication with a corresponding external liquid source, such as a cold water source 75 and a hot water source 76, e.g., the supply valve 74 may be a cold water supply valve 74 connected to the cold water source 75 and the supply valve 79 may be a hot water supply valve 79 connected to the hot water source 76. The cold water source 75 may, for example, be a commercial water supply, while the hot water source 76 may be, for example, a water heater. One or both external water sources 75, 76 may selectively supply water to the washing machine appliance 50 through each respective supply valve 74 and 79. For example, both supply valves 74 and 79 may be opened to provide warm water to the nozzle 72. As will be described in more detail below, a diverter valve 200 may be connected to the nozzle 72, e.g., upstream of the nozzle and downstream of one or both of the supply valves 74 and 79, as shown.

A drain pump 90 (shown schematically in FIG. 3) is located beneath tub 64 and basket 70 for gravity assisted flow from tub 64 to drain pump 90. As shown in FIG. 3, the drain pump 90 is positioned below the wash tub 64 along the vertical direction V within the cabinet 52, whereby wash liquid may flow from the wash tub 64 to the drain pump 90 by gravity. In various embodiments, the drain pump 90 may be directly attached to the wash tub 64, or may be connected to the wash tub 64 via a drain conduit 91, as shown in FIG. 3. The drain conduit 91 may be a hose, pipe, tube, or any other suitable conduit for flowing fluid, e.g., wash liquid, from the wash tub 64 to the drain pump 90, e.g., by gravity. The drain pump 90 is connected to a drain line 93, such that the drain pump 90 discharges wash fluid to the drain line 93. As shown in FIG. 3, the drain line 93 may also be coupled to the diverter valve 200, whereby the diverter valve 200 may selectively direct fluid from the drain line 93 to an outlet 95 or back to the tub 64 via the nozzle 72.

An agitation element 92, shown as an impeller in FIG. 3, may be disposed in basket 70 to impart an oscillatory motion to articles and liquid in chamber 73 of basket 70. In example embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 3, agitation element 92 is oriented to rotate about axis 69. Alternatively, basket 70 may provide such agitating movement, e.g., such that agitation element 92 is not required. In some embodiments, basket 70 and agitation element 92 are driven by a motor 94. Motor 94 may, for example, be a pancake motor, direct drive brushless motor, induction motor, or other motor suitable for driving basket 70 and agitation element 92. In some embodiments, motor 94 may be connected to basket 70 via a mode shifter 99. The mode shifter 99 may be selectively movable into and out of engagement with the basket 70. For example, the mode shifter 99 may engage the basket 70 so that basket 70 can be rotated by motor 94 during a spin cycle, and mode shifter 99 may disengage the basket 70 during an agitation cycle so that the motor 94 rotates the agitation element 92 independent of the basket 70. As motor output shaft 98 is rotated, basket 70 and agitation element 92 are operated for rotatable movement within tub 64, e.g., about axis 69. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 96 may be positioned in the tub 64 as illustrated. Any suitable pressure sensor 96, such as an electronic sensor, a manometer, or another suitable gauge or sensor, may be utilized. The pressure sensor 96 may generally measure the pressure of water in the tub 64. This pressure can then be utilized to estimate the height or level of water in the tub 64. Additionally, a suitable speed sensor (not shown) can be provided to measure rotational speed of basket 70 and/or agitation element 92. Other suitable sensors, such as temperature sensors, etc., may additionally be provided in the washing machine appliance 50. The structure and function of such sensors is generally understood by those of skill in the art, and as such will not be described in further detail herein.

Operation of washing machine appliance 50 is generally controlled by an appliance processing device or controller 100 that is in communication with (e.g., electrically coupled to) the input selectors 60 for user manipulation to select washing machine cycles and features. As illustrated, the input selectors 60 may be knobs or dials. In various embodiments, the input selectors 60 may include one or more user input devices, such as switches, buttons, touchscreen interfaces, etc., as well as or instead of the illustrated example input selectors 60. Appliance controller 100 may further be in communication with (e.g., electrically coupled to) various other components of appliance 50, such as supply valves 74 and 79, drain pump 90, motor 94, pressure sensor 96, and one or more other suitable sensors, etc. In response to user manipulation of the input selectors 60, appliance controller 100 may operate the various components of washing machine appliance 50 to execute selected machine cycles and features. In the illustrated example embodiment, the user interface, including the input selectors 60, is located on backsplash 56. It should be understood, however, that the controller 100 and the user interface may each be positioned in a variety of locations throughout washing machine appliance 50. Further, it should be understood that a remote interface, such as but not limited to an app running on a smartphone which communicates with the controller 100 wirelessly, e.g., via WIFI or BLUETOOTH, etc., may be provided as well as or instead of the input selectors 60.

Appliance controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, appliance controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50, such as the door 62, drain pump 90, motor 94, supply valves 74 and 79, pressure sensor 96, and various other sensors, etc. may be in communication with appliance controller 100 via one or more signal lines or shared communication busses. It should be noted that controllers 100 as disclosed herein are capable of and may be operable to perform any methods and associated method steps as disclosed herein. For example, in some embodiments, methods disclosed herein may be embodied in programming instructions stored in the memory and executed by the controller 100.

It should be appreciated that the present subject matter is not limited to any particular style, model, or configuration of washing machine appliance. The exemplary embodiment depicted in FIGS. 1 through 3 is simply provided for illustrative purposes only. While described in the context of a specific embodiment of vertical axis washing machine appliance 50, it will be understood that vertical axis washing machine appliance 50 is provided by way of example only. Other washing machine appliances having different configurations, different appearances, and/or different features may also be utilized with the present subject matter as well. For example, different locations may be provided for the user interface, different configurations may be provided, e.g., horizontal axis washing machines, and other differences may be applied as well.

Figure 4:
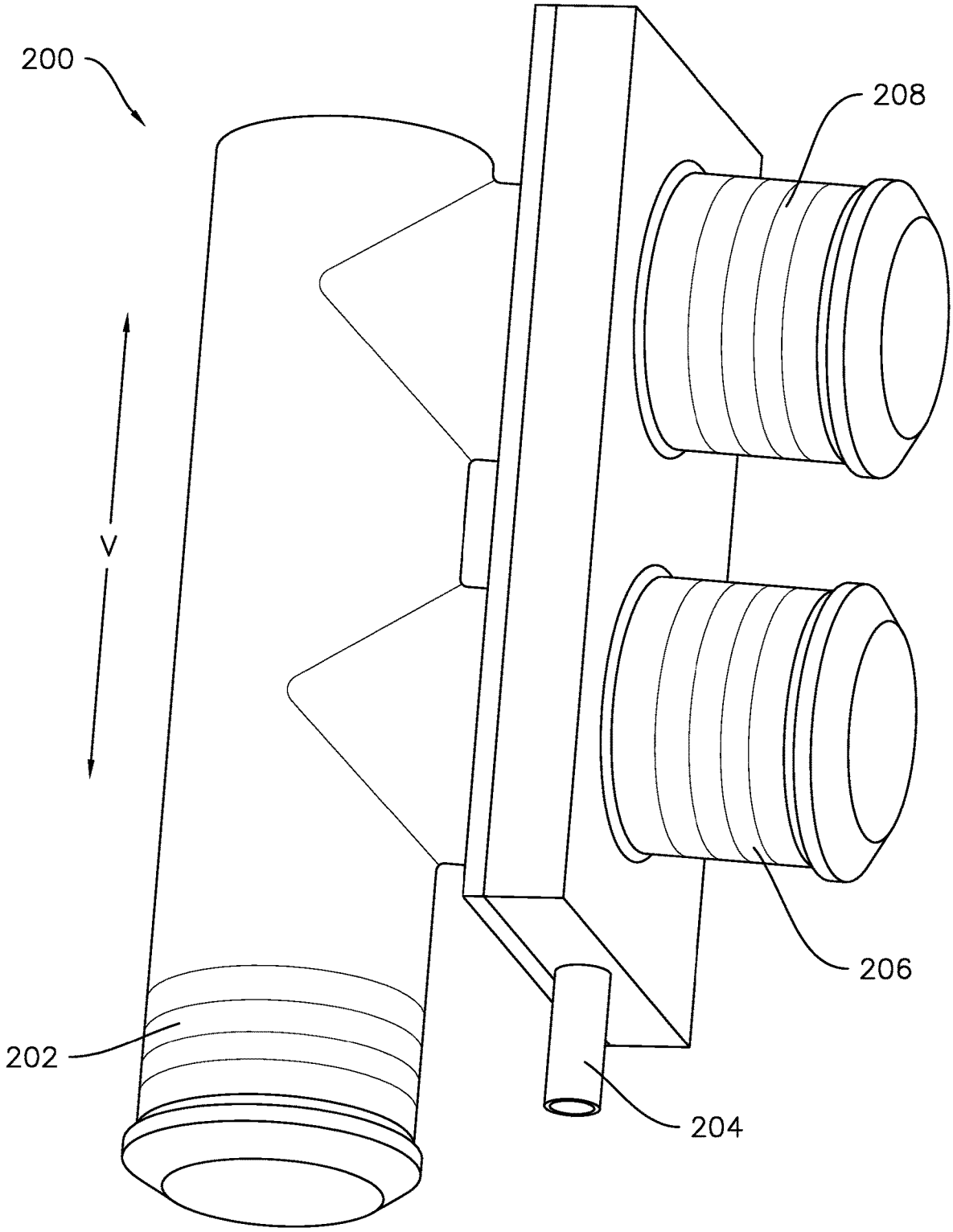
FIG. 4 provides a perspective view of a diverter valve according to one or more example embodiments of the present disclosure.

Turning now to FIG. 4, an example embodiment of a diverter valve 200 is illustrated. In some embodiments, the diverter valve 200 includes a flow inlet 202, an actuation inlet 204, a recirculation port 206, and a drain port 208. As will be described in more detail below, the diverter valve 200 may be hydraulically actuated, e.g., the diverter valve may be actuated by a flow of liquid, e.g., water, through the actuation inlet 204. As may be seen, e.g., in FIG. 4, in some embodiments, the drain port 208 may be positioned above the recirculation port 206 along the vertical direction V.

The diverter valve 200 may be connected to and in fluid communication with the drain pump 90 to receive a first flow of fluid 1000 (e.g., FIGS. 5 and 6) from the drain pump 90 and may be connected to and in fluid communication with one or both of the supply valves 74 and 79 to receive a second flow of fluid 2000 (e.g., FIG. 6) from the supply valve(s) 74 and/or 79. For example, the diverter valve 200 may be connected to the drain pump 90 at the flow inlet 202 of the diverter valve and may be connected to the supply valve(s) 74 and/or 79 at the actuation inlet 204. As will be described in more detail below, the diverter valve 200 may thereby be actuated by a pulse of flow into the actuation inlet 204.

The diverter valve 200 may include a main line 212 immediately downstream of the flow inlet 202. The main line 212 of the diverter valve 200 may extend from the flow inlet 202 to an end wall 214 of the diverter valve 200. The end wall 214 may be generally perpendicular to the flow direction of the first flow of fluid 1000. For example, the first flow of fluid 1000 may flow into the diverter valve 200 at the flow inlet 202 and may flow along a longitudinal axis of the main line 212, and the end wall 214 may be generally perpendicular to the longitudinal axis of the main line 212.

The main line 212 of the diverter valve 200 may be connected to, contiguous with, and/or in fluid communication, such as direct fluid communication, with a first inlet branch 216 and a second inlet branch 218. As illustrated, e.g., in FIGS. 5 and 6, the first inlet branch 216 may extend to and terminate at the recirculation port 206 and the second inlet branch 218 may extend to and terminate at the drain port 208. The diverter valve 200 may split the first flow of fluid 1000 into a first portion 1002 of the first flow of fluid 1000 and a second portion 1004 of the first flow of fluid 1000. As illustrated, e.g., in FIGS. 5 and 6, the first portion 1002 may travel into and through the first inlet branch 216 to or towards the recirculation port 206 and the second portion 1004 may travel into and through the second inlet branch 218 to or towards the drain port 208.

Figure 5:
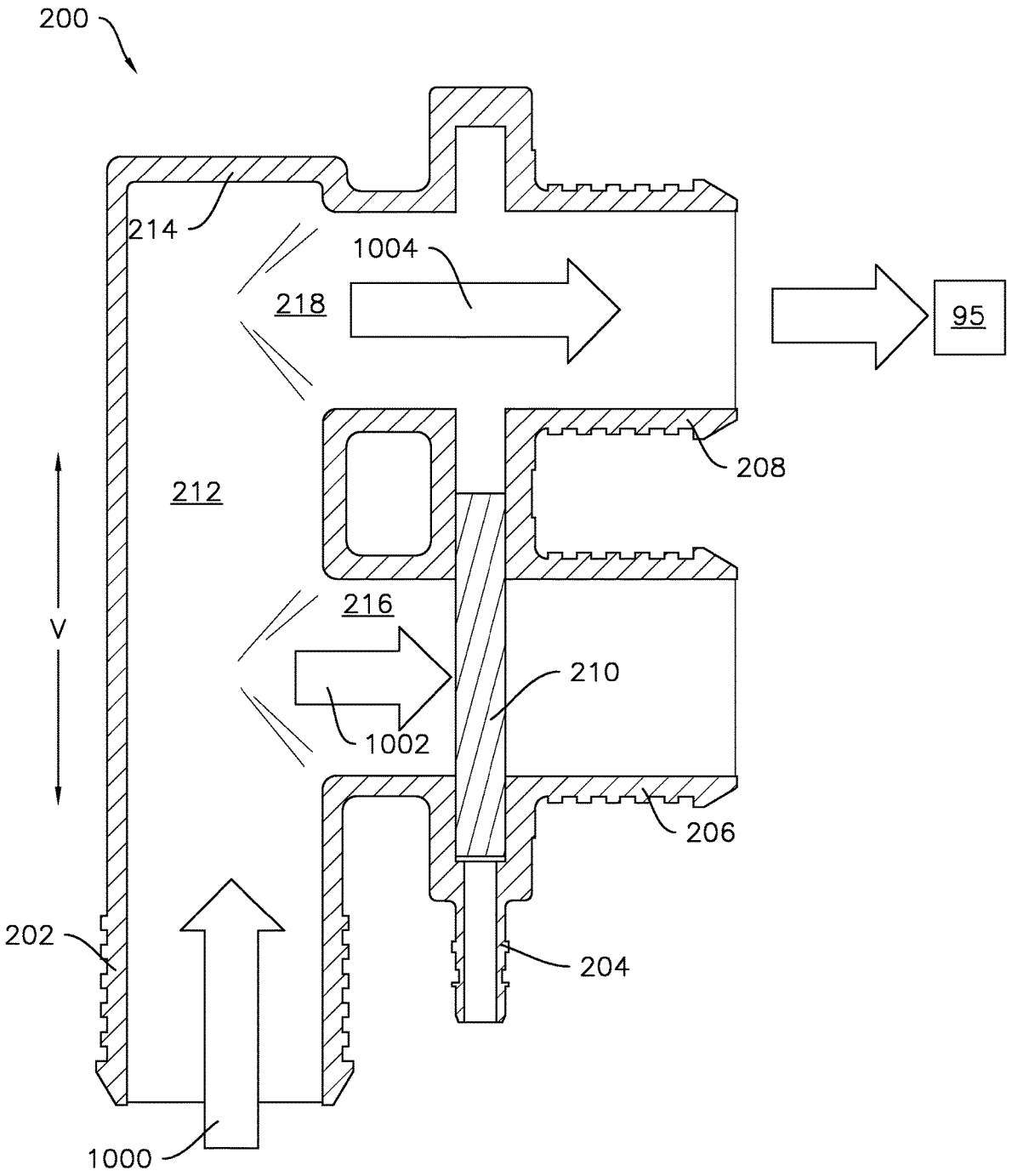
FIG. 5 provides a section view of the diverter valve of FIG. 4 in a first position.
Figure 6:
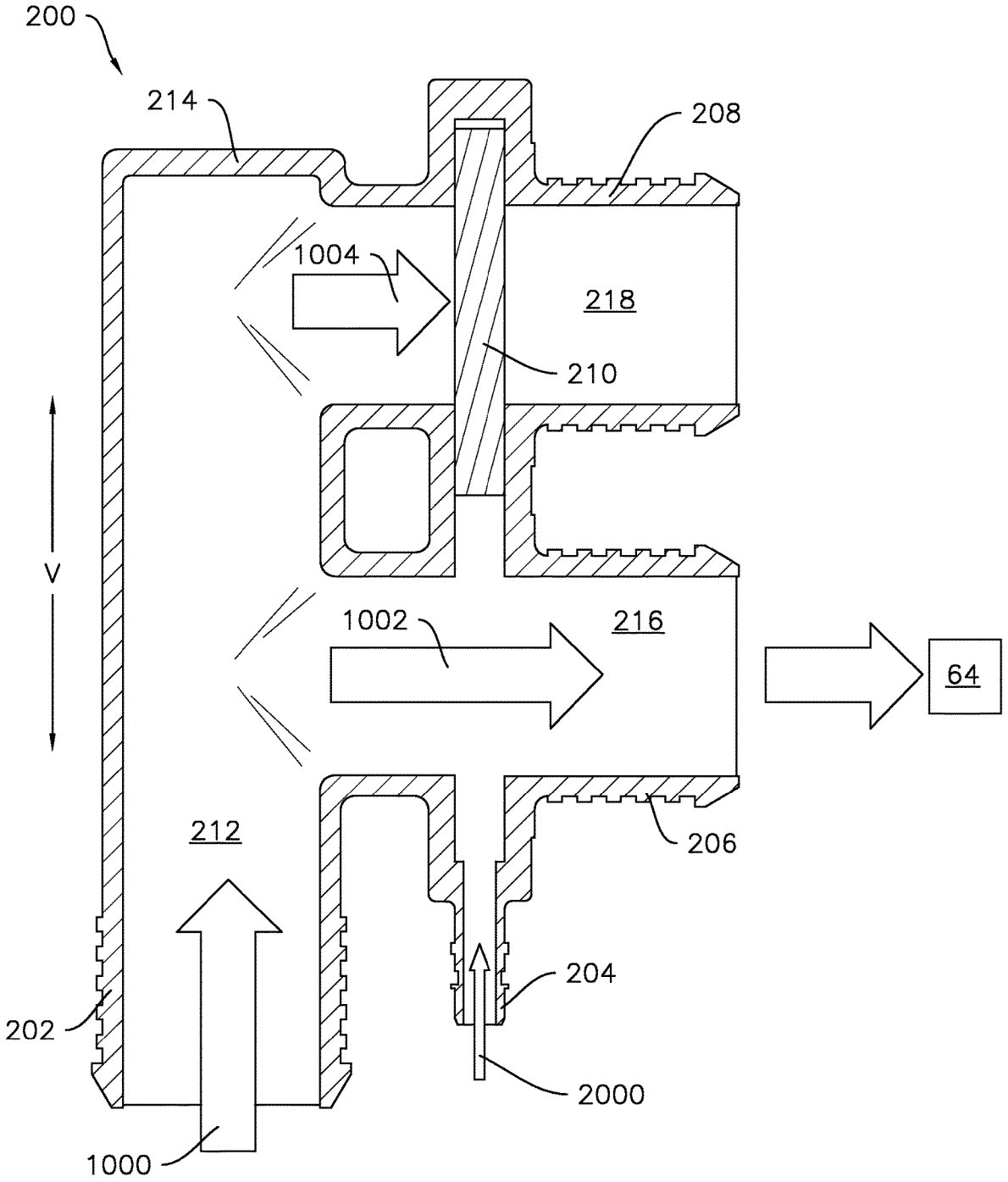
FIG. 6 provides a section view of the diverter valve of FIG. 4 in a second position.

As may be seen, e.g., in FIGS. 5 and 6, the diverter valve 200 may include a valve plate 210, and the diverter valve 200 may be selectively positioned or configured in one of a first position, e.g., as illustrated in FIG. 5, and a second position, e.g., as illustrated in FIG. 6, such as by moving the valve plate 210 of the diverter valve 200 between the first position and the second position. In the first position of the diverter valve 200 and/or of the valve plate 210, the diverter valve 200 directs the first flow of fluid 1000 from the drain pump 90 to the outlet 95. In the second position of the diverter valve 200 and/or of the valve plate 210, the diverter valve 200 directs the first flow of fluid 1000 from the drain pump 90 to the wash tub 64.

As mentioned, the diverter valve 200 may be hydraulically actuated. For example, the valve plate 210 may move from the first position to the second position in response to a flow into the diverter valve 200 from the actuation inlet 204. As illustrated for example in FIGS. 5 and 6, the valve plate 210 may be positioned downstream of the actuation inlet 204, whereby the second flow of fluid 2000 impinges on the valve plate 210, such as on an edge of the valve plate 210, and the force of the impinging second flow 2000 moves the valve plate 210 upward, e.g., upward along the vertical direction V and/or against gravity, to the second position. As mentioned, the diverter valve 200 may be connected to one of the supply valve 74 and 79 at the actuation inlet 204, such that the diverter valve 200 may be actuated by opening the corresponding supply valve 74 or 79, e.g., when the corresponding supply valve 74 or 79 is opened, the second flow of fluid 2000 may be provided from the corresponding supply valve 74 or 79, e.g., from the corresponding water source 75 or 76 via the corresponding supply valve 74 or 79, to the diverter valve 200 and in particular the valve plate 210 of the diverter valve 200.

The diverter valve 200 may be actuated by a pulse flow 2000. For example, as illustrated in FIG. 6, the second flow of fluid 2000 into and through the actuation inlet 204 may impinge on an edge, e.g., a lower edge or bottom edge, of the valve plate 210, which urges the valve plate 210 upward and into the second position. When the second flow of fluid 2000 is provided while the drain pump 90 is also active, e.g., while the first flow of fluid 1000 is present, the force of the second portion 1004 flowing through the second inlet branch 218 and towards the drain port 208 may press on the valve plate 210 and thereby hold the valve plate 210 in the second position, e.g., against the force of gravity. Thus, the second flow of fluid 2000 may be provided for a brief duration, e.g., as a pulse flow, merely long enough to move the valve plate 210 to the second position, where the second portion 1004 of the first flow of fluid 1000 then holds the valve plate 210 in the second position.

In various embodiments, the valve plate 210 may move from the second position to the first position, e.g., downward along the vertical direction V, by gravity. In some embodiments, the valve plate 210 may move from the second position to the first position when the supply valve 74 and/or 79 connected to the actuation inlet 204 is closed. In some embodiments, the valve plate 210 may move from the second position to the first position when the supply valve 74 and/or 79 is closed and the drain pump 90 is deactivated, e.g., when the first flow of fluid 1000 is discontinued or not provided to the diverter valve 200.

As illustrated in FIG. 5, when the diverter valve 200 is in the first position, the valve plate 210 extends across, such as fully or entirely across, the first inlet branch 216, e.g., perpendicular or generally perpendicular to the direction of flow of the first portion 1002 of the first flow of fluid 1000. Thus, in some embodiments, the valve plate 210 obstructs the flow of fluid, e.g., the first portion 1002, to the recirculation port 206, e.g., the first portion 1002 flows towards the recirculation port 206 but is not able to flow to the recirculation port 206 when the valve plate 210 is in the first position. Also when in the first position, the diverter valve 200 may permit fluid flow from the diverter valve 200 via the drain port 208, such as the second portion 1004 of the first flow of fluid 1000 may flow into and through the second inlet branch 218 and to the drain port 208 when the diverter valve 200, such as the valve plate 210 thereof, is in the first position.

As illustrated in FIG. 6, when the diverter valve 200 is in the second position, the valve plate 210 extends across, such as fully or entirely across, the second inlet branch 218, e.g., perpendicular or generally perpendicular to the direction of flow of the second portion 1004 of the first flow of fluid 1000. Thus, in some embodiments, the valve plate 210 obstructs the flow of fluid, e.g., the second portion 1004, to the drain port 208, e.g., the second portion 1004 flows towards the drain port 208 but is not able to flow to the drain port 208 when the valve plate 210 is in the second position. Also when in the second position, the diverter valve 200 may permit fluid flow from the diverter valve 200 via the recirculation port 206, such as the first portion 1002 of the first flow of fluid 1000 may flow into and through the first inlet branch 216 and to the recirculation port 206 when the diverter valve 200, such as the valve plate 210 thereof, is in the second position.

Figure 7:
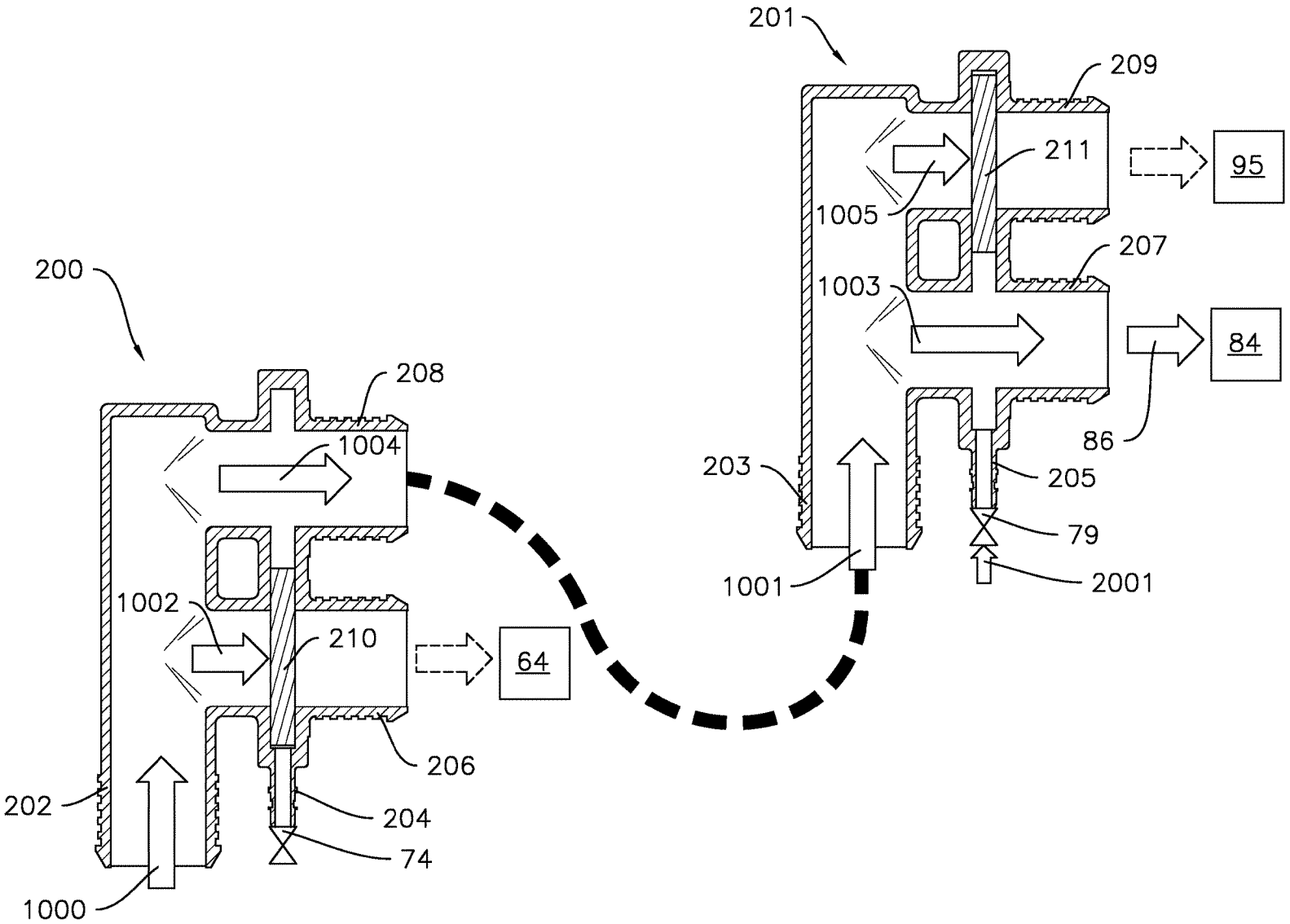
FIG. 7 provides a schematic view of a portion of a fluid circulation system including multiple diverter valves according to one or more example embodiments of the present disclosure.

As may be seen in FIG. 7, in some embodiments the washing machine appliance 50 and/or a fluid circulation system therefor may include more than one diverter valve, such as a first diverter valve 200 and a second diverter valve 201, as shown in FIG. 7. It should be understood that the second diverter valve 201 is substantially identical to the first diverter valve 200, apart from the relative position and flow order. For example, the diverter valves 200 and 201 may be connected in series, e.g., as illustrated in FIG. 7 with the second diverter valve 201 downstream of the first diverter valve 200. In such configuration, the washing machine appliance 50 and/or a fluid circulation system thereof may provide or include three positions. For example, one of the three possible positions is illustrated in FIG. 7. In particular, the position illustrated in FIG. 7 may be a secondary recirculation position where the flow of fluid from the drain pump 90 is directed along a secondary recirculation path 86 to the wash tub 64, such as to an additive vessel 84, such as to the wash tub 64 via the additive vessel 84, where the fluid from the drain pump 90 may mix with an additive, e.g., detergent or any other suitable additive, in the additive vessel 84. The additive vessel 84 is depicted schematically in FIG. 7. The structure and operation of additive vessels are generally understood by those of ordinary skill in the art and, as such, are not illustrated or described in further detail herein.

Figure 8:
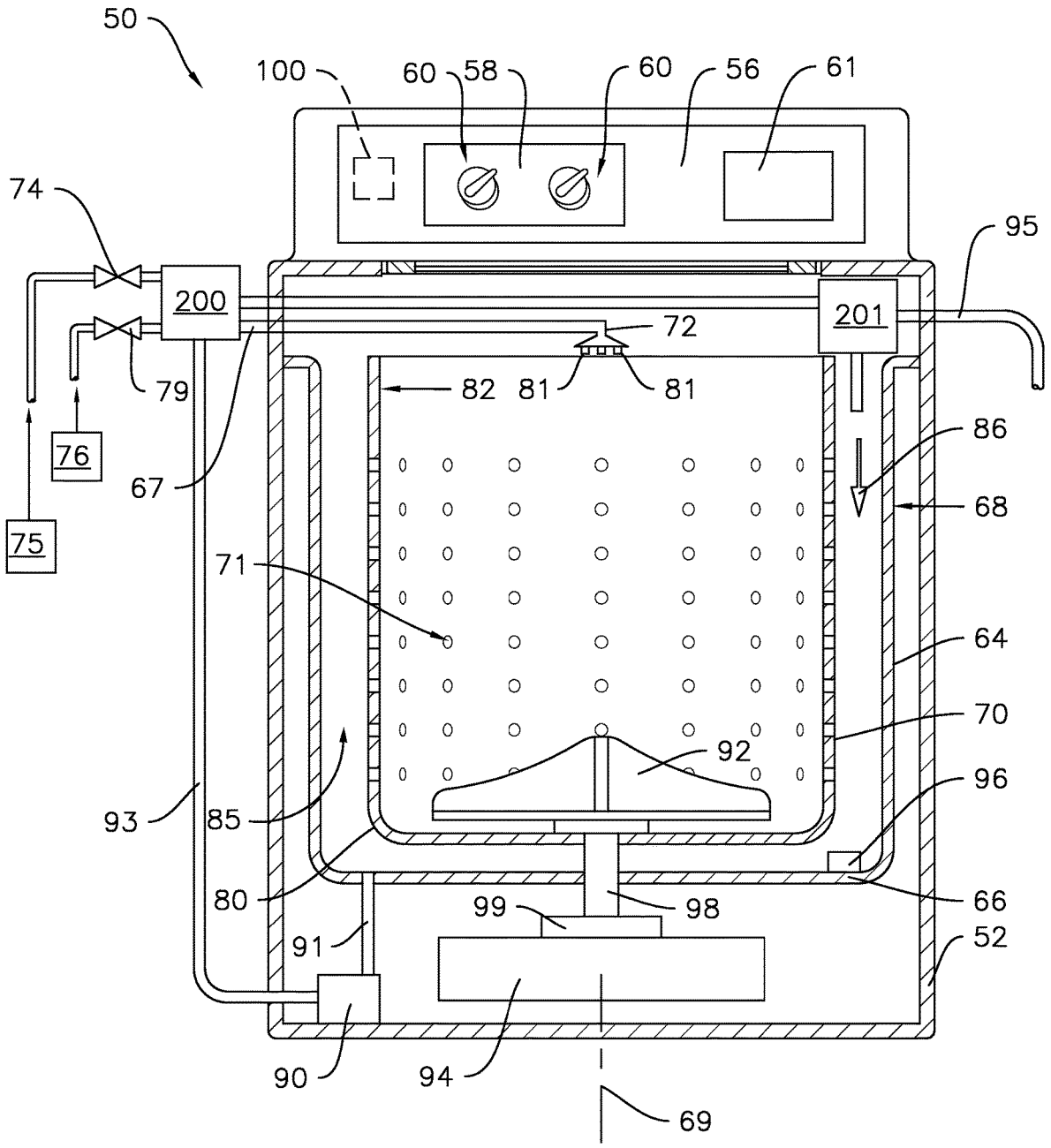
FIG. 8 provides a front cross-sectional view of the washing machine appliance of FIG. 1 according to one or more additional example embodiments of the present disclosure.

When multiple diverter valves are provided, each diverter valve may be connected to a respective supply valve. For example, as illustrated in FIG. 7, the first diverter valve 200 may be connected to the supply valve 74 and the second diverter valve 201 may be connected to the supply valve 79. In additional embodiments, the connection may be reversed, for example the supply valve 79 may be directly connected to the first diverter valve 200 and the supply valve 74 may be directly connected to the second diverter valve 201. As illustrated in FIG. 7, the first diverter valve 200 is in the first position, whereby the first flow of fluid 1000 from the drain pump 90 is directed to the drain port 208. Also as illustrated in FIG. 7, the flow inlet 203 of the second diverter valve 201 is connected to the drain port 208 of the first diverter valve 200. Thus, when the first diverter valve 200 is in the first position, the first flow of fluid 1000 to the first diverter valve 200, e.g., the second portion 1004 thereof, is directed to the second diverter valve 201. The second portion 1004 from the first diverter valve 200 then becomes a first flow 1001 to the second diverter valve 201. When or after a second flow 2001 is provided to the second diverter valve 201, such as to and/or through the actuation inlet 205 of the second diverter valve 201, the second diverter valve 201 may be in a second position, e.g., as illustrated in FIG. 7, where the valve plate 211 of the second diverter valve 201 obstructs and, in at least some embodiments, is held in the second position by, the second portion 1005 of the first flow 1001 into the second diverter valve 201, such that the flow does not travel to the drain port 209 of the second diverter valve 201. With the second diverter valve 201 in the second position, the first portion 1003 of the first flow 1001 into the second diverter valve 201 may be directed to and through the recirculation port 207 of the second diverter valve 201, e.g., whereby the first portion 1003 of the first flow 1001 into the second diverter valve 201 flows to the secondary recirculation path 86, where the secondary recirculation path 86 may, in some embodiments, include the additive vessel 84, e.g., the secondary recirculation path 86 to the wash tub 64 may include flowing to the wash tub 64 via the additive vessel 84. In additional embodiments, e.g., as illustrated in FIG. 8, the secondary recirculation path 86 may not include the additive vessel 84 and may instead include flowing the fluid to the wash tub 64 outside of the basket 70. In some embodiments where the secondary recirculation path 86 does not include the additive vessel 84, additive mixing may be provided in the wash tub 64 outside of the basket 70. Thus, the diverter valves 200 and 201 may be in a secondary recirculation position when the first diverter valve 200 is in the first position and the second diverter valve 201 is in the second position.

Additionally, although not specifically illustrated, it will be apparent to one of ordinary skill in the art that the example diverter valves 200 and 201 illustrated in FIG. 7 may also be configured in a drain position, where the first diverter valve 200 is in the first position to direct the flow of fluid from the drain pump 90 to the second diverter valve 201, and the second diverter valve 201 is in the first position, to direct the flow of fluid from the drain pump 90 to the outlet 95 via the drain port 209 of the second diverter valve 201, as indicated by the dashed arrow from the drain port 209 of the second diverter valve 201 in FIG. 7. Further, the example diverter valves 200 and 201 illustrated in FIG. 7 may also be configured in a recirculation position when the first diverter valve is in the second position (e.g., by opening supply valve 74 to actuate the first diverter valve 200), such that the first diverter valve 200 directs the first flow of fluid 1000 from the drain pump 90 to the wash tub 64 via the recirculation port 206 of the first diverter valve 200, as indicated by the dashed arrow from the recirculation port 206 of the first diverter valve 200 in FIG. 7. In at least some embodiments, the recirculation position of the first and second diverter valves 200 and 201 may include directing the fluid immediately to the wash basket 70 from the first diverter valve 200, e.g., providing direct fluid communication from the first diverter valve 200 to the wash basket 70, where "direct" or "immediate" in this context means without flowing through the additive vessel 84 or to the wash tub 64 outside of the wash basket 70, e.g., in contrast to the secondary recirculation position described above.

Figure 9:
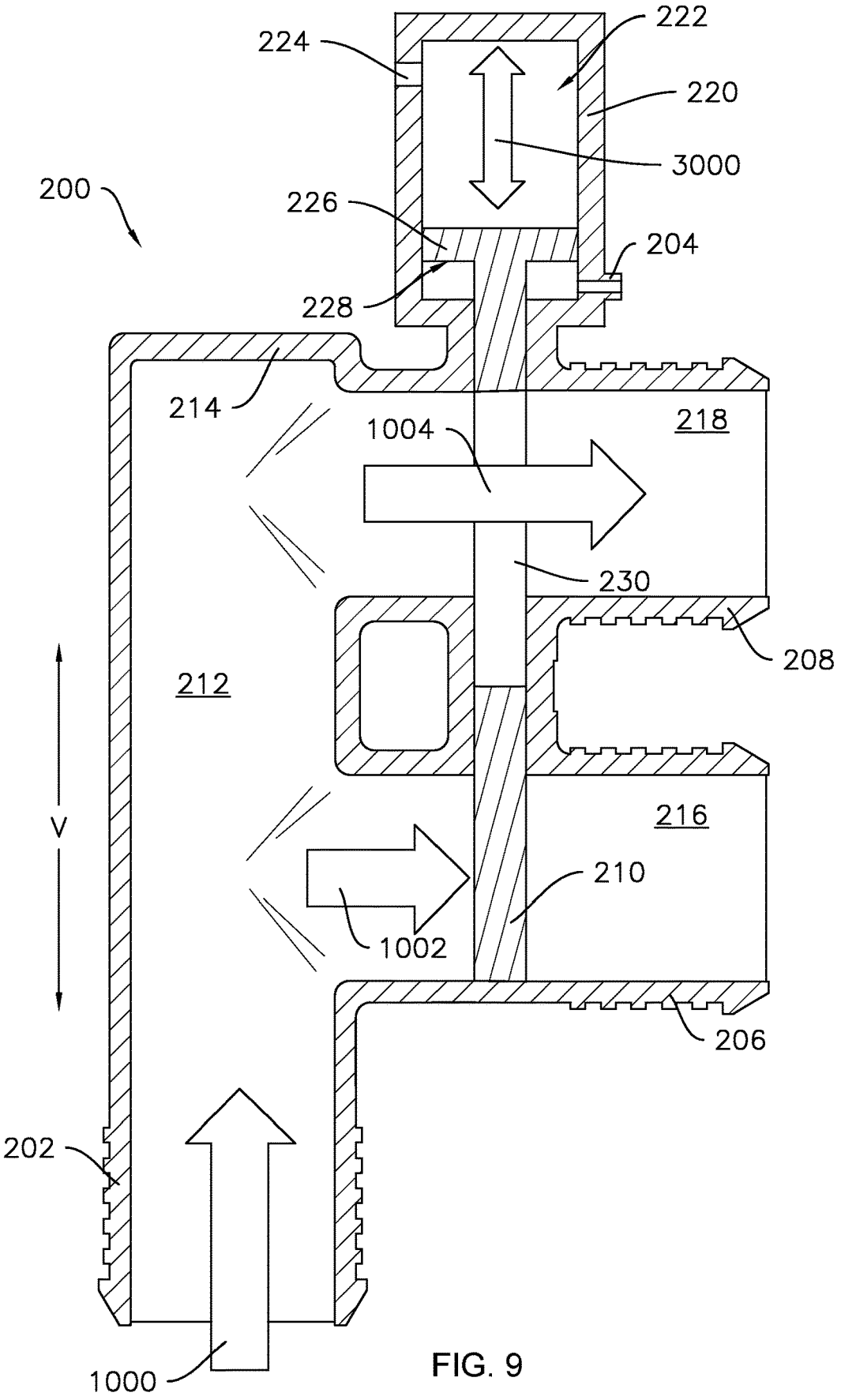
FIG. 9 provides a section view of a diverter valve according to one or more additional example embodiments of the present disclosure.

An additional example embodiment of the diverter valve 200 is illustrated in FIG. 9. In some embodiments, e.g., as shown in FIG. 9, the diverter valve 200 may include a reservoir 220 which defines an internal volume 222. The reservoir 220 may be in fluid communication with the actuation inlet 204 of the diverter valve 200, such as in direct fluid communication with and/or immediately downstream of, the actuation inlet 204. In such embodiments, the second flow of fluid 2000 (e.g., FIG. 6) may flow into the internal volume 222 of the reservoir 220 when the corresponding supply valve is opened. The valve plate 210 may include a flange 226 and the flange 226 may be disposed within the reservoir 220. The flange 226 may be movable within the reservoir 220, e.g., up and down as indicated by arrow 3000 in FIG. 9. Thus, fluid in the reservoir 220 may push on the flange 226, such as on a bottom surface 228 thereof, to lift the valve plate 201 from the first position to the second position, e.g., up along the arrow 3000 in FIG. 9. A vent 224 may be provided in the reservoir 220 to prevent or reduce pressure above the flange 226 of the valve plate 210. When the valve 74 or 79 connected to the actuation inlet 204 is closed, the reservoir 220 may drain or the pressure within the internal volume 222 thereof may otherwise dissipate, such that the valve plate 210 moves down along arrow 3000, e.g., by gravity, back to the first position from the second position, when the fluid pressure is no longer acting on the flange 226, such as when the fluid pressure within the internal volume 222 of the reservoir 220 at and below the bottom surface 228 of the flange 226 is no longer sufficient to lift the valve plate 210 against gravity.

Also as illustrated in FIG. 9, the valve plate 210 may include an aperture 230. In such embodiments, the aperture 230 of the valve plate 210 may be generally aligned with the drain port 208 of the diverter valve 200 when the valve plate 210 is in the first position. For example, the aperture 230 of the valve plate may be generally aligned with the drain port 208 when the aperture 230 and the drain port 208 are concentric or generally concentric, e.g., when an offset between the center point of the aperture 230 and the center point of the drain port 208 is within 10% of a major dimension, e.g., diameter, of the aperture 230. As another example, the aperture 230 and the drain port 208 may be generally concentric when the geometric center of the aperture 230 and the geometric center of the drain port 208 are colinear along a line generally perpendicular to the vertical direction V, such as along the flow direction of the second portion 1004 of the first flow of fluid 1000 into the diverter valve 200. Thus, in such embodiments, when the diverter valve 200 is in the first position, e.g., as illustrated in FIG. 9, the valve plate 210 obstructs flow through the first inlet branch 216 of the diverter valve 200, while the aperture 230 of the valve plate 210 permits flow through the second inlet branch 218 to the drain port 208, e.g., through the aperture 230. Additionally, in such embodiments, when the valve plate 210 is in the second position, the valve plate 210 obstructs the second inlet branch 218, in a similar manner as described above with respect to the example embodiments illustrated in FIGS. 5 through 8.

Figure 10:
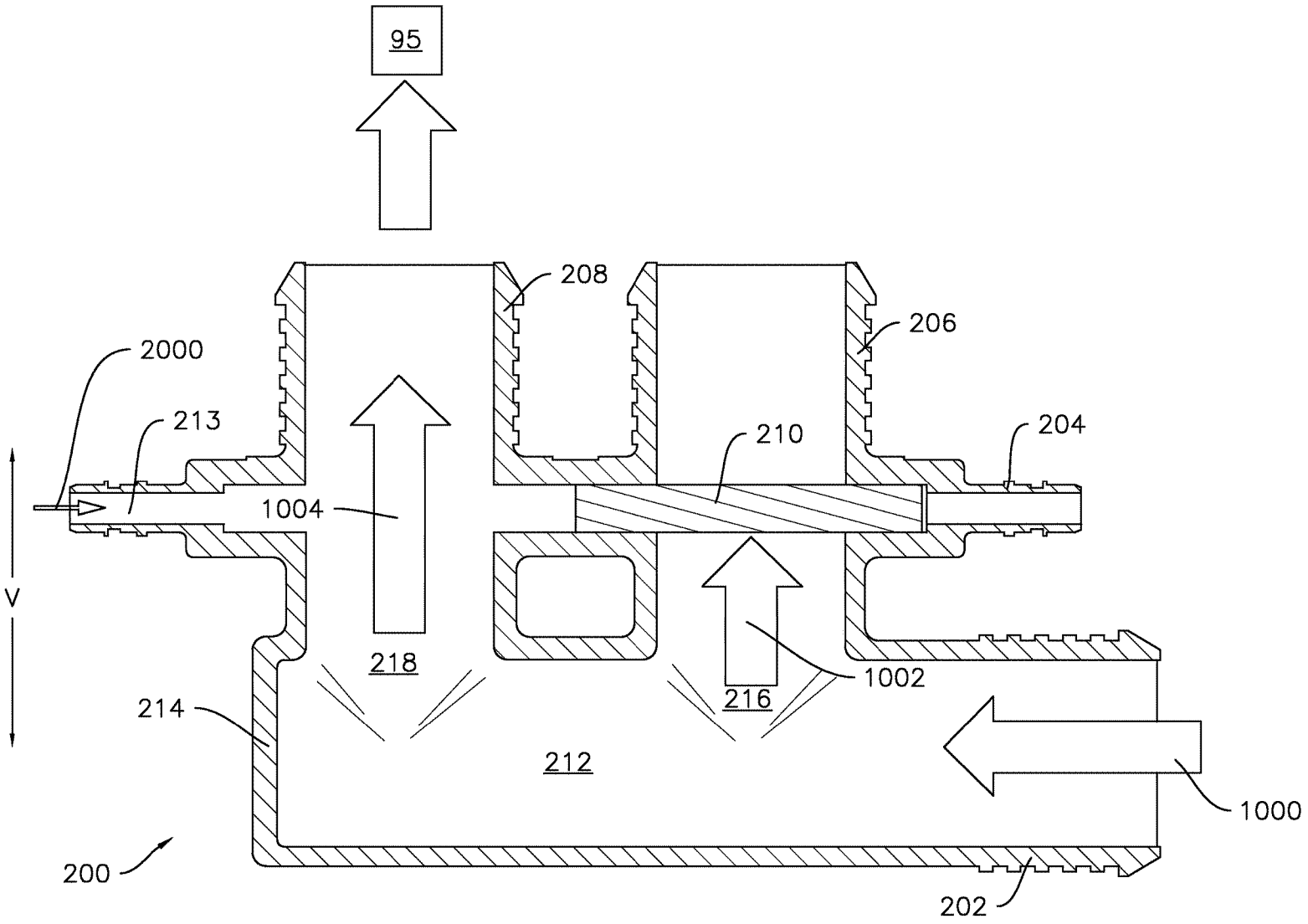
FIG. 10 provides a section view of a diverter valve according to one or more further example embodiments of the present disclosure in a first position.
Figure 11:
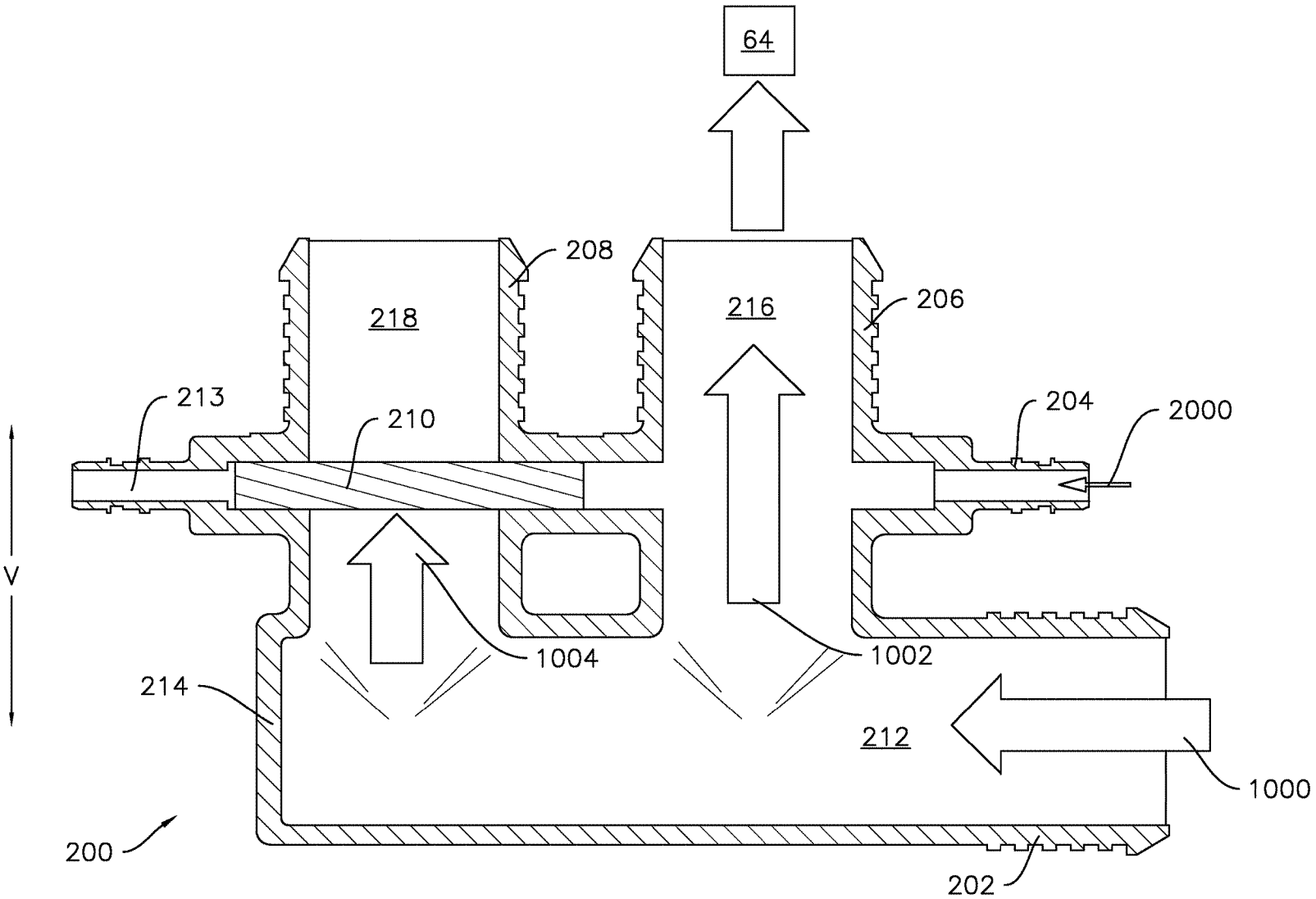
FIG. 11 provides a section view of the diverter valve of FIG. 10 in a second position.

In some embodiments, e.g., as illustrated in FIGS. 10 and 11, the diverter valve 200 may be configured to operate in a non-vertical position, e.g., when oriented oblique or perpendicular to the vertical direction V. For example, the diverter valve may be oriented horizontally, e.g., perpendicular to the vertical direction V, such as along one of the lateral direction L or the transverse direction T, or otherwise in a lateral-transverse plane defined by the lateral direction L and the transverse direction T. In such embodiments, the first position of the valve plate 210 (FIG. 10) may be spaced apart from the second position of the valve plate 210 (FIG. 11) along the non-vertical, e.g., horizontal, direction. Thus, in contrast to the embodiments described above where the valve plate 210 may move from the second position to the first position by gravity, the diverter valve 200 may include a second actuation inlet 213, e.g., opposite the first actuation inlet 204. In such embodiments, when the second flow of fluid 2000 is provided to the second actuation inlet 213, e.g., as illustrated in FIG. 10, the valve plate 210 will be urged to the first position by the second flow of fluid 2000.

As mentioned above, features illustrated or described as part of one embodiment can be used with another embodiment to yield a still further embodiment. For example, one or both of the diverter valves 200 illustrated in FIG. 7 may be substituted with the embodiment of the diverter valve 200 illustrated in FIG. 9 or FIGS. 10 and 11.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet extending between a top and a bottom along a vertical direction;

a wash tub mounted within the cabinet and configured for containing fluid during operation of the washing machine appliance;

a wash basket rotatably mounted within the wash tub, the wash basket defining a wash chamber configured for receiving laundry articles;

a drain pump positioned below the wash tub within the cabinet;

a hydraulically actuated diverter valve coupled to the drain pump, the diverter valve in fluid communication with the drain pump downstream of the drain pump, the diverter valve configured to selectively direct a flow of fluid from the drain pump to one of the wash tub or an outlet of the washing machine appliance; and a supply valve fluidly coupled to a water supply, wherein the supply valve is connected to an actuation inlet of the diverter valve, whereby the diverter valve is actuated by opening the supply valve.

2. The washing machine appliance of claim 1, wherein the diverter valve comprises a valve plate, the valve plate downstream of an actuation inlet whereby the valve plate moves from a first position in which the diverter valve directs the flow of fluid from the drain pump to the outlet to a second position in which the diverter valve directs the flow of fluid from the drain pump to the wash tub in response to a flow into the diverter valve from the actuation inlet.

3. The washing machine appliance of claim 2, further comprising a supply valve fluidly coupled to a water source, wherein the supply valve is connected to the actuation inlet of the diverter valve, whereby the valve plate moves from the first position to the second position when the supply valve is opened.

4. The washing machine appliance of claim 3, wherein the valve plate moves to the first position from the second position by gravity when the supply valve is closed.

5. The washing machine appliance of claim 2, wherein the diverter valve comprises a drain port coupled to the outlet of the washing machine appliance upstream of the outlet and a recirculation port upstream of the wash tub, wherein the valve plate is upstream of the recirculation port and obstructs liquid flow through the recirculation port when the valve plate is in the first position, wherein the valve plate is upstream of the drain port and obstructs liquid flow through the drain port when the valve plate is in the second position.

6. The washing machine appliance of claim 1, wherein the diverter valve comprises an actuation inlet, a reservoir immediately downstream of the actuation inlet, and a valve plate configured to move between a first position and a second position, the valve plate comprising a flange, the flange of the valve plate positioned within the reservoir whereby the valve plate moves from the first position to the second position when the reservoir is filled with fluid.

7. The washing machine appliance of claim 6, wherein the valve plate comprises an aperture, the aperture of the valve plate aligned with a drain port of the diverter valve when the valve plate is in the first position.

8. The washing machine appliance of claim 1, wherein the diverter valve is a first diverter valve comprising a drain port and a recirculation port, further comprising a second hydraulically actuated diverter valve downstream of the first diverter valve, the second hydraulically actuated diverter valve fluidly coupled to the drain port of the first diverter valve, wherein the second diverter valve is configured to selectively direct a flow of fluid from the first diverter valve to one of the outlet of the washing machine appliance or a secondary recirculation path to the wash tub of the washing machine appliance.

9. The washing machine appliance of claim 1, further comprising a nozzle in fluid communication with the wash tub and configured to provide a flow of liquid to the wash tub, the nozzle downstream of the diverter valve such that the diverter valve selectively directs the flow of fluid from the drain pump to the wash tub through the nozzle.

10. A fluid circulation system of a washing machine appliance, the fluid circulation system comprising:

a wash tub configured for containing fluid during operation of the washing machine appliance;

a drain pump positioned below the wash tub;

a hydraulically actuated diverter valve coupled to the drain pump, the diverter valve in fluid communication with the drain pump downstream of the drain pump, the diverter valve configured to selectively direct a flow of fluid from the drain pump to one of the wash tub or an outlet of the washing machine appliance; and a supply valve fluidly coupled to a water supply, wherein the supply valve is connected to an actuation inlet of the diverter valve, whereby the diverter valve is actuated by opening the supply valve.

11. The fluid circulation system of claim 10, wherein the diverter valve comprises a valve plate, the valve plate downstream of an actuation inlet whereby the valve plate moves from a first position in which the diverter valve directs the flow of fluid from the drain pump to the outlet to a second position in which the diverter valve directs the flow of fluid from the drain pump to the wash tub in response to a flow into the diverter valve from the actuation inlet.

12. The fluid circulation system of claim 11, further comprising a supply valve fluidly coupled to a water supply, wherein the supply valve is connected to the actuation inlet of the diverter valve, whereby the valve plate moves from the first position to the second position when the supply valve is opened.

13. The fluid circulation system of claim 12, wherein the valve plate moves to the first position from the second position by gravity when the supply valve is closed.

14. The fluid circulation system of claim 11, wherein the diverter valve comprises a drain port coupled to the outlet of the washing machine appliance upstream of the outlet and a recirculation port upstream of the wash tub, wherein the valve plate is upstream of the recirculation port and obstructs liquid flow through the recirculation port when the valve plate is in the first position, wherein the valve plate is upstream of the drain port and obstructs liquid flow through the drain port when the valve plate is in the second position.

15. The fluid circulation system of claim 10, wherein the diverter valve comprises an actuation inlet, a reservoir immediately downstream of the actuation inlet, and a valve plate configured to move between a first position and a second position, the valve plate comprising a flange, the flange of the valve plate positioned within the reservoir whereby the valve plate moves from the first position to the second position when the reservoir is filled with fluid.

16. The fluid circulation system of claim 15, wherein the valve plate comprises an aperture, the aperture of the valve plate aligned with a drain port of the diverter valve when the valve plate is in the first position.

17. The fluid circulation system of claim 10, wherein the diverter valve is a first diverter valve comprising a drain port and a recirculation port, further comprising a second hydraulically actuated diverter valve downstream of the first diverter valve, the second hydraulically actuated diverter valve fluidly coupled to the drain port of the first diverter valve, wherein the second diverter valve is configured to selectively direct a flow of fluid from the first diverter valve to one of the outlet of the washing machine appliance or a secondary recirculation path to the wash tub of the washing machine appliance.

18. The fluid circulation system of claim 10, further comprising a nozzle in fluid communication with the wash tub and configured to provide a flow of liquid to the wash tub, the nozzle downstream of the diverter valve such that the diverter valve selectively directs the flow of fluid from the drain pump to the wash tub through the nozzle.

* * * * *